US005846020A

United States Patent [19]

McKeown

[11] Patent Number: 5,846,020

[45] Date of Patent: Dec. 8, 1998

[54] PRE-FABRICATED MULTI-LEVEL ROADWAY STRUCTURE

[76] Inventor: Kevin McKeown, P.O. Box 7228, Washginton, D.C. 20044

[21] Appl. No.: 883,457

[22] Filed: Jun. 26, 1997

[51] Int. Cl.[6] ..... E01D 15/12

[52] U.S. Cl. ..... 404/1; 404/2; 404/6; 14/2.4

[58] Field of Search ..... 14/2.4, 6, 73, 74, 14/78; 404/1, 6, 2, 73

[56] References Cited

U.S. PATENT DOCUMENTS

| | | | |
|---|---|---|---|
| 3,301,146 | 1/1967 | Krug et al. | 404/1 |
| 3,411,167 | 11/1968 | Sedlacek . | |
| 3,811,147 | 5/1974 | Dix . | |
| 4,181,995 | 1/1980 | Zur . | |
| 4,604,841 | 8/1986 | Barnoff et al. . | |
| 4,953,249 | 9/1990 | Warwick . | |
| 5,042,957 | 8/1991 | Arita et al. . | |
| 5,177,913 | 1/1993 | Erel . | |

FOREIGN PATENT DOCUMENTS

| | | | |
|---|---|---|---|
| 0424223 | 4/1991 | European Pat. Off. | 404/1 |

*Primary Examiner*—James A. Liesehora

[57] ABSTRACT

The invention effectively multiplies a roadway vertically by allowing automobiles to travel on top of each other. Each section of the invention is a pre-fabricated reinforced concrete multi-level roadway structure that covers an existing lane of traffic on a roadway. The invention is easily cast, transported, assembled and moved, as needed. The cover of the lower roadway forms the roadway of the upper lane of traffic. The bottom section of the invention is made up of two "Jersey-type" barriers which have vertical columns that then support the upper roadway section. The upper section of the invention contains "Jersey-type" barriers for safety.

1 Claim, 3 Drawing Sheets

PRE-FABRICATED MULTI-LEVEL ROADWAY STRUCTURE

BACKGROUND OF THE INVENTION

The invention relates to a new and novel pre-fabricated multi-level roadway structure, more specifically to a roadway structure constructed and assembled in a timely and cost effective fashion that results in greater traffic flow, a heightened atmosphere of safety and efficiency for road construction workers, and a safer driving environment for drivers.

Traffic related conditions affect virtually every person on earth. The problem of the ever increasing number of automobiles and trucks is exasperated by the much needed and constant repair and enhancement of all roadways. The negative results of the high volume of traffic, and its' associated problems, are further increased as the demand on goods and services grows with a growing population. The daily near-shut-down of the movement of people and product is not confined to large cities. Indeed, traffic stagnation directly and indirectly impacts every individual and business on the planet. The cost of the traffic related waste is enormous. Everyone pays, either monetarily or in the loss of valuable time.

Economic growth is lessened when people cannot, or will not, subject themselves to the tortured time associated with traveling to purchase goods and services when they are confronted with nearly every roadway in the throws of some re-construction or when the highways they now travel can more accurately be described as slow moving parking lots. The huge expansion of the mail-order industry over the past fifteen years is evidence of a society drained from the hassles of movement. However, the products must still be transported, and they are, ultimately by roadway to the purchaser.

The much needed repair and maintenance of our roadways presents additional problems. Of course, the safety of our treasured roadway workers is of paramount importance. Under current conditions, the associated costs are high-essential, but costly. The roadways are so over-burdened that the vast costs are no longer confined to any specific time of day. No longer can night time road construction be used as a temporary solution. It is obvious that traffic problems are in effect twenty-four hours a day, seven days a week on our already over-capacity highways.

The purpose of the present invention is to cost effectively increase the flow of traffic by a significant percentage. This new and novel pre-fabricated multi-level roadway structure will simultaneously provide greater safety to roadway workers and will allow said roadway work to be performed in a shorter period of time. The greater safety afforded the roadway workers and the lessening of the time involved in completing a highway project will subsequently reduce overall costs.

The inventor is aware of the following U.S. Pat Nos. which show efforts made to solve some of the problems described above: 4,181,995; 5,042,957; 4,953,249; 3,811,147; 5,177,913; 3,411,167; 4,604,841.

Also, the current invention vastly reduces the aggravation and inconvenience to individual drivers. Along with a marked percentage decrease in the "hassle factor" to all drivers, the results include a safer driving environment and one which presents more available driving options especially during inclement weather conditions.

SUMMARY OF THE INVENTION

This invention relates to a plurality of cast concrete steel-reinforced sections disposed end to end and easily connected and unconnected as needed. When the instant invention is positioned on top of a roadway lane, or the like, the result is a multi-level roadway that multiplies the capacity of traffic flow in nearly the same horizontal space.

The bottom section of the invention consists of two roadway barriers, possibly a "Jersey-type" barrier, each positioned parallel to each other, at a distance from each other the approximate width of the bottom roadway lane, or consistent with a specific need. At each end of the barrier, vertical steel reinforced cement columns provide the section attachment areas as well as the support environment for the upper-level roadway. Although, the upper-level roadway can be either open or enclosed, for explanation purposes here, the roadway is open. The sides of the upper-level roadway consist of barrier type structures at such a height to provide the necessary safety and to promote a feeling of openness.

The invention here presents short-term and long-term solutions. In the case of roadway construction, the use of pre-fabricated multi-level roadway sections allow added safety for construction workers understandingly pre-occupied with traffic in a dangerous environment. If necessary, the position of the structure can be easily moved to another location.

The presence of the multi-level roadway section on a permanent basis allows for "rush-hour" traffic needs to be met as the volume dictates. For example, the upper level of the invention can be used during heavy inbound city commuters in the morning and then switched to the corresponding heavy outbound city commuters in the afternoon.

The invention allows for the specific routing of vehicles similar to the current use of High Occupancy Vehicle lanes. Also, those traveling through a congested area can now be given the option of using an express lane of the multi-level system.

Certain municipalities will be able to use the instant invention for designated walking, running, bicycle, motorcycle and emergency related purposes, as needed. As options in the alternative power areas evolve, the current invention provides an environment for cost-effective implementation. For example, battery powered automobiles could easily be connected to power sources imbedded in the structure of the invention's sides.

The invention allows for safe options in the face of severe weather conditions. Even large quantities of snow, with a small enhancement, will not pass through the lower enclosed driving area. Metal screens can be placed from the top section of the lower barrier to the bottom section of the upper roadway. The feeling of openness and the proper ventilation would still exist but drifting snow would not present itself as a problem.

Access to the upper roadway is gained by an angled ramp section system to allow access, or at such a position where perpendicular overpasses allow for the entering and exiting of vehicles to the upper portion of the multi-level roadway system.

BRIEF DESCRIPTION OF THE DRAWINGS

The features of the present invention which are believed to be novel are set forth by description within this application and may best be understood with reference to the accompanying drawings in which.

DETAILED DESCRIPTION OF THE INVENTION

This invention relates to a plurality of cast concrete steel-reinforced sections disposed end to end and easily connected and unconnected as needed.

The bottom section of the invention consists of two roadway barriers, possibly a "Jersey-type" barrier, each positioned parallel to each other, at a distance from each other the approximate width of the bottom roadway lane, or consistent with a specific need. At each end of the barrier, vertical steel reinforced cement columns provide the section attachment areas as well as the support environment for the upper-level roadway. Although, the upper-level roadway can be either open or enclosed, for explanation purposes here, the roadway is open. The sides of the upper-level roadway consist of barrier type structures at such a height to provide the necessary safety and to promote a feeling of openness.

For purposes of explanation here, the focus will be on a doubling structure; thus, the lower roadway with the second roadway above covering the bottom lane. Of course, the number of roadways comprising this multi-level structure is only limited by structural and vertical considerations.

Sections of the present invention are constructed in such a fashion and method allowing for the curving and horizontal angling consistent with the base roadway lane, as necessary.

Figure 1:
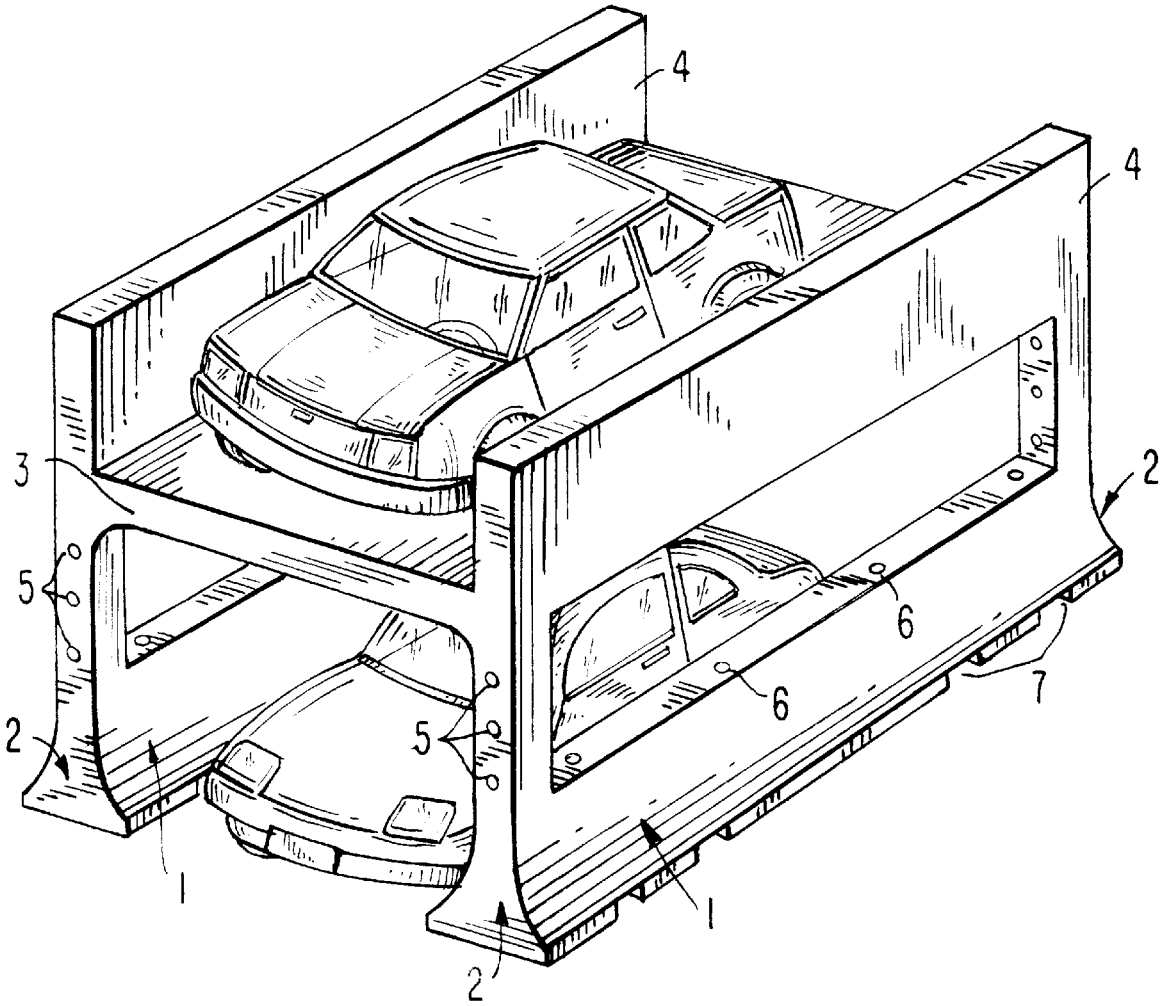
FIG. 1 is an angled view illustrating the novel multi-level roadway section incorporating the present invention.
Figure 2:
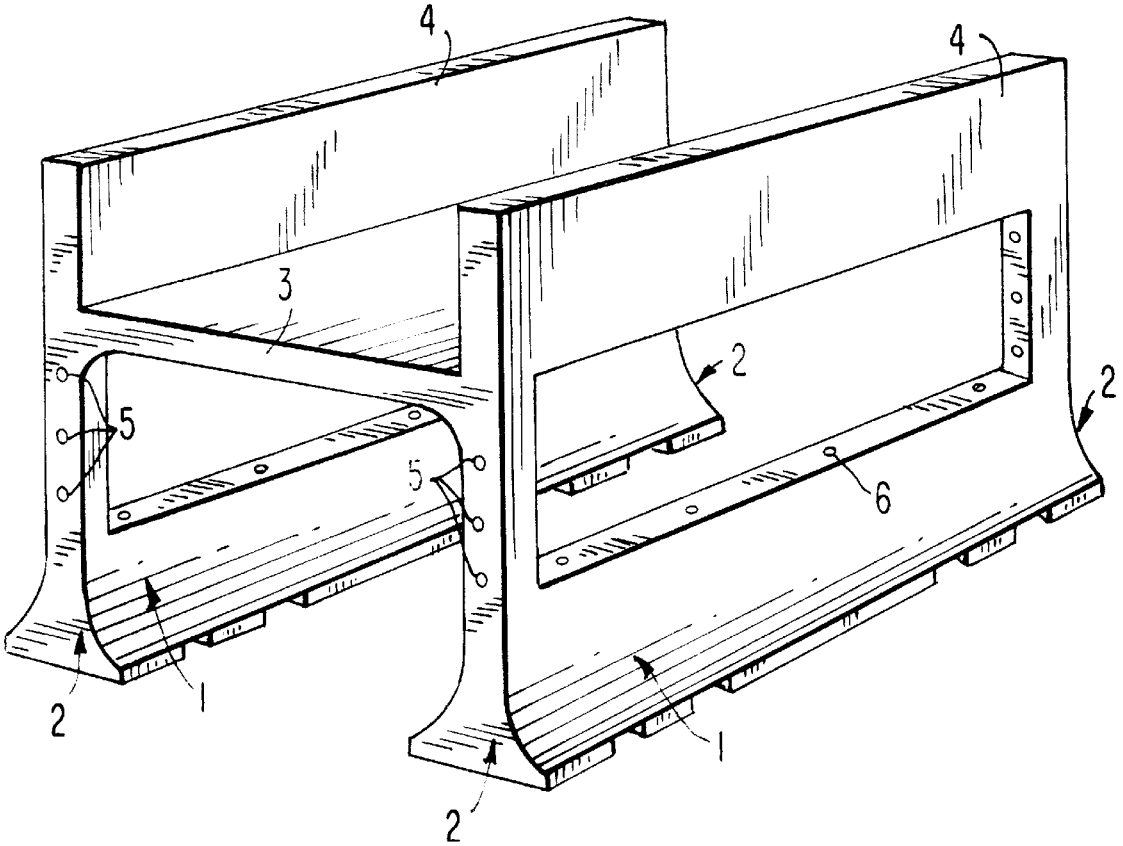
FIG. 2 is an angled representation as shown in FIG. 1
Figure 3:
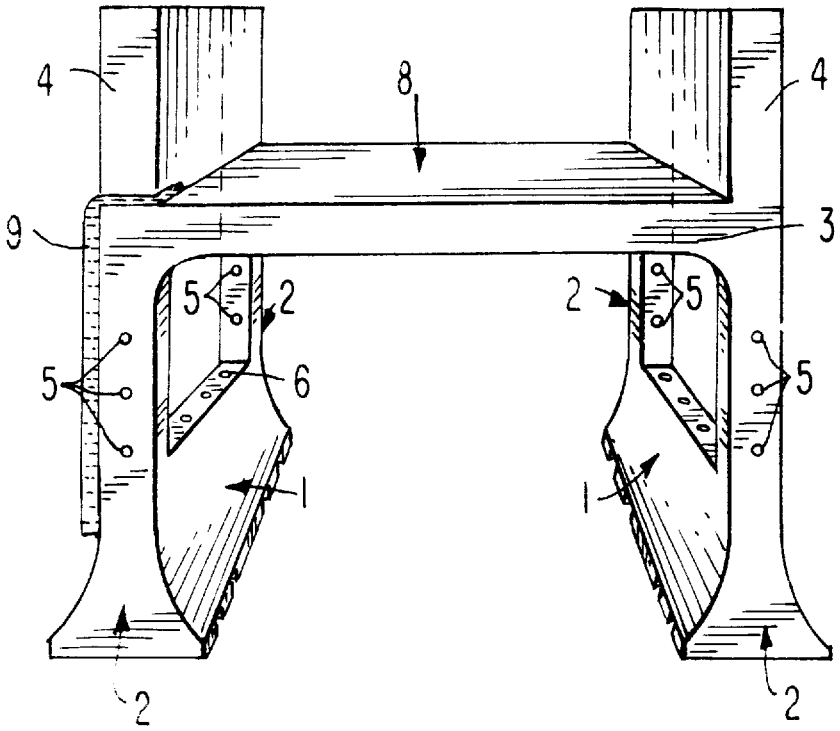
FIG. 3 is a front perspective view of the instant invention.

Referring to FIG. 1, an angled view is shown illustrating the novel multi-level roadway section with the envisioned use of automobiles vertically arranged in the same horizontal area. "Jersey-type" barriers 1 form the base of the instant invention. The vertical side supports 2 include a support column at each end thereof to provide support for the upper level roadway 3. The horizontal upper roadway 3 forms the top of the lower level and the actual driving surface of the upper level. The upper level side barriers 4 provide the safety needed on the upper roadway. The connection between sections 5 is made with bolts through holes in each sections support column. Anchoring rods 6 can be applied where needed. Drainage channels 7 allow for runoff water. The upper roadway surface 8 in FIG. 3 is sufficiently angled to allow runoff through drainage channel means 9.

What is claimed:

1. A prefabricated reinforced concrete roadway section for use in constructing a multilevel roadway structure comprising:

a pair of laterally spaced elongated side supports each having an elongated base portion formed generally as a "Jersey barrier" and provided with a vertically oriented support column at each end thereof, the support columns on opposite side supports being laterally aligned and supporting a section of elevated roadway surface extending between and along the length of the side supports, each of said side supports including end portions provided with means for connecting to a side support of an adjacent roadway section;

wherein each said elongated base portion has a bottom surface adapted to be mounted on an existing roadway traffic surface and at least one anchoring rod for anchoring said base portion to said existing roadway traffic surface, said bottom surface including recesses therein for forming drainage channels between said base portion and said roadway traffic surface when said base portion is mounted on said existing roadway traffic surface:

wherein said elevated roadway surface includes upper level side barriers along each side of said elevated roadway surface, wherein upper level drainage channels are provided through said upper level side barriers and permit runoff from said elevated roadway surface, and wherein said means for connecting to an adjacent roadway section includes bolts through holes in adjacent support columns.

* * * * *